United States Patent [19]

Donaldson et al.

[11] 4,429,253

[45] Jan. 31, 1984

[54] THYRATRONS

[75] Inventors: Timothy P. Donaldson, Great Totham; Christopher V. Neale, Peverel; Hugh Menown, Writtle, all of England

[73] Assignee: English Electric Valve Company Limited, Chelmsford, England

[21] Appl. No.: 261,809

[22] Filed: May 8, 1981

[30] Foreign Application Priority Data

May 10, 1980 [GB] United Kingdom ..... 8015571
Nov. 14, 1980 [GB] United Kingdom ..... 8036631

[51] Int. Cl.[3] ..... H01J 17/04
[52] U.S. Cl. ..... 313/573; 313/599
[58] Field of Search ..... 313/204, 205, 220, 318, 313/38, 180, 191, 186

[56] References Cited

U.S. PATENT DOCUMENTS 2,766,397 10/1956 Nienhuis ..... 313/180
3,165,660 1/1965 Menown ..... 313/191 X

FOREIGN PATENT DOCUMENTS 774452 5/1957 United Kingdom .

*Primary Examiner*—David K. Moore
*Assistant Examiner*—Sandra L. O'Shea
*Attorney, Agent, or Firm*—Spencer & Frank

[57] ABSTRACT

The invention provides a glass enveloped thyratron having an anode carried by an anode pin extending through a glass neck in the thyratron envelope and forming a pant leg. The anode is surrounded by a screening box operated at cathode potential which has a back plate with a tubular portion extending away from the anode into the interior of said pant leg to surround said anode pin. The outer surface of the extremity of the pant leg is flared outwardly adjacent the back plate into engagement with a mounting collar secured to the rear of the back plate. The tubular portion of the back plate extends within the pant leg for a distance substantially greater than the extent to which the pant leg is enclosed by the mounting collar.

8 Claims, 2 Drawing Figures

THYRATRONS

This invention relates to thyratrons and more specifically to thyratrons having glass envelopes.

Figure 1:
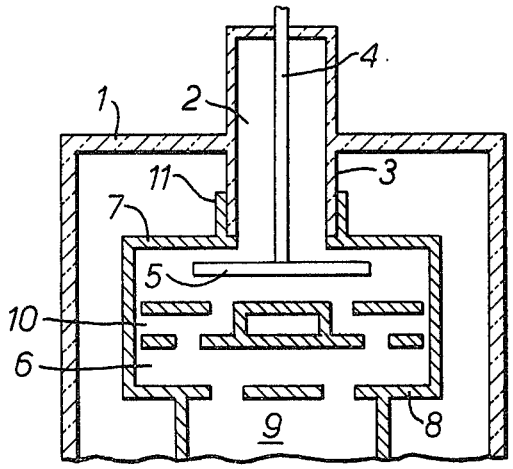

The anode portion of a typical modern glass enveloped thyratron is illustrated schematically in FIG. 1 of the accompanying drawings.

Referring to FIG. 1 the glass envelope of the thyratron is represented at 1. This has a neck 2 of generally cylindrical form extending both upwardly as shown and downwardly into the interior of the thyratron, forming what is known as a "pant leg" 3. Through the neck 2 extends an anode pin 4 which carries the anode 5 of the thyratron. The anode 5 is enclosed within what is known as an anode box 6 which is a screening box maintained at cathode potential. The box 6 comprises a back plate 7 behind the anode 5 and an apertured front plate 8 in front of the anode 5 and between the anode 5 and the cathode (not shown) which is located in the space generally referenced 9. Within the box 6 is a series of electrodes represented at 10 which act as control grids. The exact nature of these last mentioned grids is not material to the present invention and will not be described in detail.

The anode box 6 is carried from the pant leg 3. As will be seen a cylindrical portion 11 of the back plate 7 extends upwardly and around the outside of the pant leg 3.

Compared to a ceramic enveloped thyratron a glass enveloped thyratron such as is described with reference to FIG. 1 possesses a number of advantages not the least being the greater ease with which it may be constructed. However, traditionally, for use in situations where large reverse voltages occur, sometimes for periods of seconds, the ceramic envelope thyratron has tended to be used because of its ability to withstand high hold-off voltages. One object of the present invention is to provide an improved glass envelope thyratron which is better able to withstand high hold-off voltages than is often the case with such a thyratron.

According to this invention a glass enveloped thyratron is provided having an anode carried by an anode pin extending through a glass neck in the thyratron envelope and forming a tubular pant leg, said anode being surrounded by a screening box having a back plate with a tubular portion extending away from said anode into the interior of said pant leg to surround said anode pin, said tubular portion being exposed to said anode pin without the intermediary of glass material, usually over its entire length.

Preferably a mounting collar secured to the rear of said back plate is provided to surround and engage with the outer surface of the extremity of said pant leg, adjacent said back plate, which is flared outwardly into engagement with said mounting collar.

Preferably said tubular portion of said back plate extending into the interior of said pant leg extends into a recess provided in said pant leg. Preferably again the internal dimensions over the length of said tubular portion of said back plate correspond to the internal dimensions over the major part of the non-recessed length of said glass neck.

Preferably said tubular portion extends within said pant leg for a distance substantially greater than the extent to which said pant leg is enclosed by said mounting collar.

Preferably the anode facing edges and corners of said back plate and said mounting collar and the front plate of said screening box, which front plate is located between said anode and the cathode of said thyratron, are rounded off. Preferably again any electrode structures also within said screening box also have any anode facing edges and corners rounded off.

Preferably again the anode facing surfaces of the back plate, mounting collar and front plate are polished smooth.

The invention is further described with reference to FIG. 2 of the accompanying drawings which is a section showing the anode end of one example of a thyratron in accordance with the present invention.

Figure 2:
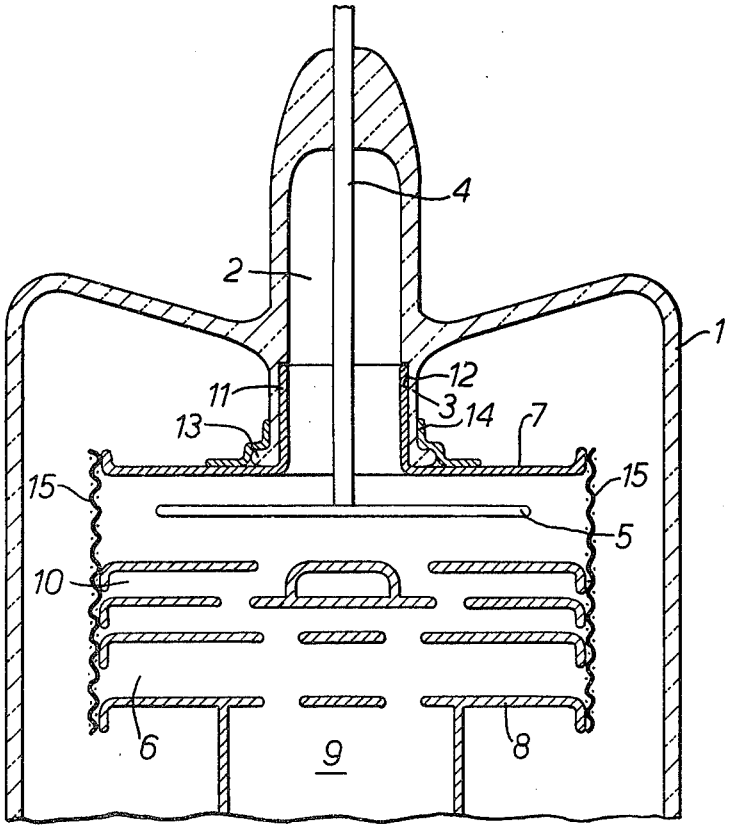

Referring to FIG. 2 it will be seen that this is somewhat less schematic than FIG. 1 although where appropriate like references are used for like parts. It will be seen that the principal difference between the thyratron illustrated in FIG. 1 and the thyratron illustrated in FIG. 2 is that the cylindrical portion 11 of the back plate 7 in this case extends on the inside of the pant leg 3. In fact the inner surface of the pant leg 3 is recessed as shown at 12 in order to accommodate the cylindrical portion 11 of the back plate 7. The inner diameter of the cylindrical portion 11 is the same as the inner diameter of the remaining unrecessed portion of the neck 2.

In addition at the extremity of the pant leg 3 adjacent the back plate 7 the outer surface of the pant leg is flared outwardly as represented at 13. A mounting collar 14 surrounds and engages with the flared surface at the extremity of the pant leg and is secured to the back plate 7 so that the back plate 7 and the pant leg 3 are secured together. With this construction it will be noted that between the cylindrical portion 11 of the back plate 7 and the anode stem 4 there is no intervening glass portion of the envelope as there is in the thyratron shown in FIG. 1. This avoids a common cause of breakdown in the prior construction caused by the electrical stress through the intervening glass material of the pant leg 3 between the anode stem 4 and the tubular portion 11 of the back plate 7 which is of course at cathode potential.

In addition the anode facing edges and corners of the back plate 7 the mounting collar 14 and the front plate 8 of the cathode screening box 6 are rounded off as are the anode facing edges of the series of electrodes 10 within the cathode box 6. Also the surfaces of the back plate 7 and the front plate 8 which face the anode are highly polished and the sides 15 of the box 6 extending between the back plate 7 and the front plate 8 are made of rounded wire mesh so as inherently to have no sharp edges or corners.

The last mentioned additional features contribute to the avoidance of undesired breakdown but it is the avoidance of glass envelope material between the anode stem 4 and the tubular portion 11 of the back plate 7 and thus the possibility of fracture of this vital part of the envelope which contributes most of the ability of the thyratron to withstand high hold-off voltages not normally associated with glass enveloped thyratrons.

We claim:

1. A glass enveloped thyratron having an anode carried by an anode pin extending through a glass neck in the thyratron envelope and forming a tubular pant leg, said anode being surrounded by a screening box having a back plate with a tubular portion extending away from said anode into the interior of said pant leg to surround said anode pin, said tubular portion being exposed to said anode pin without the intermediary of glass material, and wherein a mounting collar secured to the rear of said back plate is provided to surround and engage with the outer surface of the extremity of said pant leg adjacent said back plate, and said pant leg is flared outwardly, at said extremity, into engagement with said mounting collar.

2. A thyratron as claimed in claim 1 and wherein said tubular portion is exposed to said anode pin without the intermediary of glass material over its entire length.

3. A thyratron as claimed in claim 1 and wherein said tubular portion of said back plate extending into the interior of said pant leg extends into a recess provided in said pant leg.

4. A thyratron as claimed in claim 3 and wherein the internal dimensions over the length of said tubular portion of said back plate correspond to the internal dimensions over the major part of the non-recessed length of said glass neck.

5. A thyratron as claimed in claim 1 and wherein said tubular portion extends within said pant leg for a distance substantially greater than the extent to which said pant leg is enclosed by said mounting collar.

6. A thyratron as claimed in claim 1 and further including a cathode, wherein said back plate and said mounting collar each have respective anode facing edges and corners which are rounded off and said screening box has a front plate which is located between said anode and said cathode and which is rounded off.

7. A thyratron as claimed in claim 6 and further including additional electrode structures within said screening box, said additional electrode structure having anode facing edges and corners which are rounded off.

8. A thyratron as claimed in claim 1 and further including a cathode, wherein said screening box has a front plate located between said anode and said cathode, and said back plate, mounting collar and front plate each having a respective anode facing surface which is polished smooth.

* * * * *